United States Patent [19]

Ma

[11] Patent Number: 4,718,829

[45] Date of Patent: Jan. 12, 1988

[54] NOISE REDUCTION USING SUCTION GAS TO FOAM OIL

[75] Inventor: Wei-Ming W. Ma, Williamsville, N.Y.

[73] Assignee: American Standard Inc., New York, N.Y.

[21] Appl. No.: 4,935

[22] Filed: Jan. 20, 1987

[51] Int. Cl.[4] ..... F25B 43/02

[52] U.S. Cl. ..... 417/372; 417/902; 62/468

[58] Field of Search ..... 62/468, 467, 470, 471; 417/53, 54, 372, 902

[56] References Cited

U.S. PATENT DOCUMENTS

| | | | |
|---|---|---|---|
| 3,155,312 | 11/1964 | Douglas | 417/372 |
| 3,480,205 | 11/1969 | Hatten | 417/372 |
| 3,482,769 | 12/1969 | Larsen | 417/372 |
| 3,507,193 | 4/1970 | Jensen | 92/153 |
| 4,063,853 | 12/1977 | De Groat | 417/53 |
| 4,127,994 | 12/1978 | Niven | 62/469 |

*Primary Examiner*—Henry A. Bennet

*Attorney, Agent, or Firm*—William J. Beres; Robert J. Harter; Carl M. Lewis

[57] ABSTRACT

A first portion of a pitot tube-like device faces into the incoming stream of suction gas which enters the hermetic shell of a low-side reciprocating compressor. A second portion of the device extends downwardly toward the oil sump within the shell. The device terminates in a third portion which defines a plurality of apertures and which is immersed in the oil within the sump. The dynamic pressure or velocity head of the incoming suction gas stream is converted within the device to static pressure as a result of the resistance to flow through the device. The resistance to flow through the device is a function of, among other things, the static head at the immersed aperture locations. The device is configured such that sufficient static pressure is developed internal of it to both drive any oil out of the submerged portion of the device at compressor startup and to maintain a steady, predetermined rate of flow of suction gas through the immersed apertures into the sump oil during steady state compressor operation. Suction gas entering the sump oil at the immersed aperture locations bubbles to the surface of the oil in the sump where the bubbles coalesce to form a noise attenuating blanket of foam around the motorcompressor unit within the shell.

12 Claims, 3 Drawing Figures

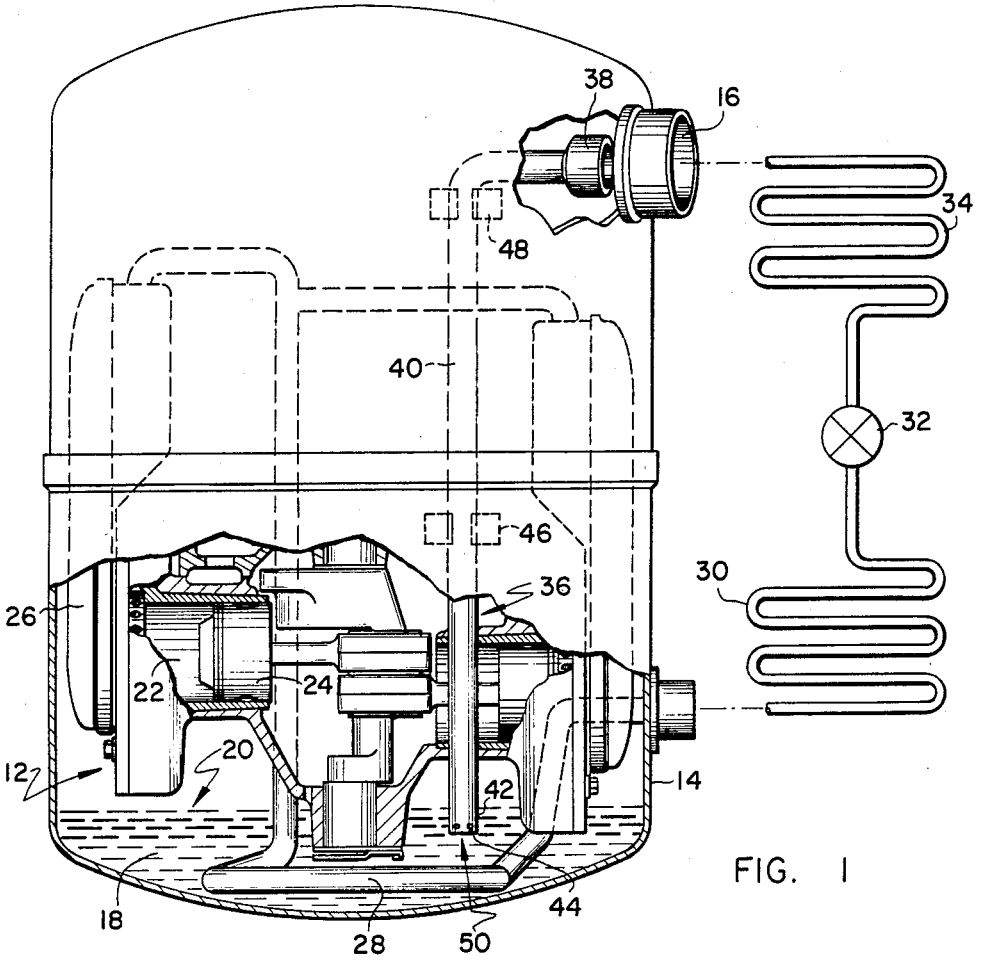
FIG. 1
FIG. 2
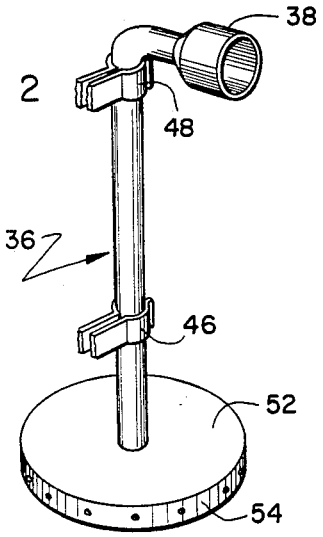
FIG. 3
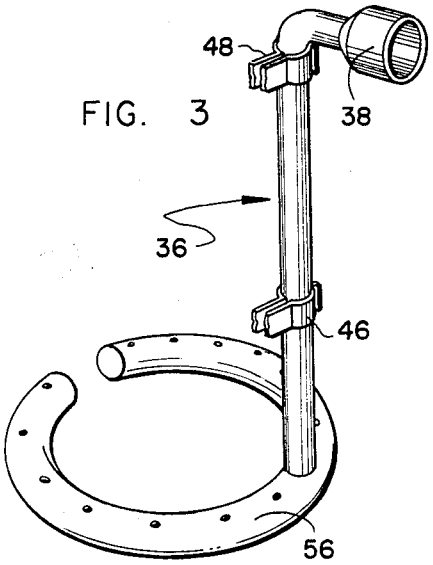

NOISE REDUCTION USING SUCTION GAS TO FOAM OIL

FIELD OF THE INVENTION

The present invention relates to the suppression of noise created in a compressor. More particularly, the present invention relates to the suppresion of noise in a hermetic low-side refrigeration compressor by foaming the oil in the sump thereof with suction gas.

BACKGROUND OF THE INVENTION

The use of mechanical agitators, sound deadening insulation, pumping mechanisms, compressed gas, baffles and/or a combination of two or more of the above to quiet refrigeration compressors is known to those skilled in the refrigeration compressor art.

The requirement for noise attenuation in such compressors stems from their typical location in and around residences and offices where such noise can be both annoying and distracting. Concerns extend to the elimination of oil dripping noise, such as in U.S. Pat. No. 3,482,769, to the prevention of oil sloshing noise, as in U.S. Pat. No. 3,480,205 and, most commonly, to the attenuation of the noise which is mechanically generated by the operation of a motor-compressor unit within the shell which surrounds it.

U.S. Pat. No. 4,127,994 is typical in its illustration of a mechanical stirrer attached to the lower end of the crankshaft of a shell mounted motor-compressor unit. The operation of the motor-compressor unit and the movement of the crankshaft causes the stirrer, which is at least partially immersed in the sump oil, to aerate the oil, thereby creating a blanket of bubbles which attenuates the transmission of noise from the motor-compressor unit to and out of the compressor shell. It has been specifically recognized, however, that unless precautions are taken, the mechanical agitation of sump oil can cause the particles of debris which commonly find their way to the bottom of the sump in a compressor shell to be stirred into the oil. This same oil is circulated to compressor bearing surfaces and any debris therein can shorten compressor bearing life.

U.S. Pat. No. 4,063,853, recognizing that the use of mechanical agitation to foam sump oil can be disadvantageous, teaches a secondary oil pump in a refrigeration compressor which serves to disentrain refrigerant which has become entrained in the sump oil. The pump, in cooperation with a very specific distribution arrangement, directs disentrained refrigerant gas and oil over the outside surfaces of the motor-compressor unit to absorb the acoustical energy generated by the unit.

U.S. Pat. No. 3,507,193, assigned to the assignee of the present invention, illustrates the use of compressed refrigerant gas which is blown by the pistons into the crankcase of a reciprocating compressor to foam oil in the compressor sump. Positive control over crankcase pressure is accomplished by the employment of a crankcase vent and drain arrangement. While such arrangements have proven reliable in the past with respect to single piston/cylinder compressors, insufficient pressure pulsation has been found to be created in the crankcase of certain dual-piston in-line reciprocating compressors to allow for the use of blown-by and compressed crankcase gas to foam sump oil.

Finally, the advantages of using suction gas to foam oil in a compressor sump have been recognized by Douglas in U.S. Pat. No. 3,155,312. The apparatus by which suction gas is communicated to the sump oil in Douglas is, however, such that clogging of the apparatus can drastically affect the ability of the compressor to function since all of the suction gas entering the compressor is constrained to flow through the apparatus.

Consequently, there exists a need for apparatus by which the oil in a refrigeration compressor sump can be foamed, independent of the operation and mechanical movement of the motor-compressor unit and the failure of which will not affect the supply of suction gas to the compressor.

SUMMARY OF THE INVENTION

It is an object of the present invention to foam oil in the sump of a hermetically sealed motor-compressor unit using suction gas and without resorting to the mechanical agitation of sump oil. It is another object of the present invention to foam sump oil essentially independent of the operation of the motor-compressor unit in a compressor shell and in a manner such that the failure of the sump oil foaming apparatus will not affect the supply of suction gas to the compressor. It is a further object of the present invention to foam sump oil without directly relying on the interaction of any moving compressor parts with sump oil. It is still another object of the present invention to foam compressor sump oil in a low-side refrigeration compressor without relying on gas which has been mechanically compressed to a pressure in excess of suction pressure. Finally, it is an object of the present invention to accomplish noise supression in a hermetically sealed low-side refrigeration compressor in an expedient and economical fashion.

The above-mentioned objects together with others which will become apparent when the following description of the preferred embodiment is considered in conjunction with the attached drawing figures and claims are accomplished by apparatus and a method which converts dynamic pressure, as embodied by the velocity head of suction gas entering a compressor shell, to static pressure which is then employed to drive suction gas into the oil in the compressor's sump. A foamy blanket of bubbles is thereby developed which acts to attenuate motor-compressor generated noise within the shell of the compressor.

The apparatus by which such conversion of dynamic to static pressure is accomplished is a pitot tube-like device having an inlet that is spaced apart from but which faces into the suction inlet which opens into the compressor shell. The tube-like device extends generally downward into the oil sump at the bottom of the shell. The lower end of the device, which is submerged in the oil sump, contains a plurality of apertures. The velocity pressure of the suction gas entering the compressor shell is converted to static pressure within the device. The static pressure thus developed causes the suction gas within the device to bubble out of the apertures in its submerged end at a controlled rate and in a controlled fashion, thereby creating a layer of noise attenuating bubbles within the compressor shell.

The primary advantages of the apparatus are its independence of the direct movement and mechanical operation of the motor-compressor unit within the shell and its independence of mechanically compressed gas. Other advantages relate to the ease of fabrication of the apparatus as well as to its relatively insignificant cost. Additionally, the apparatus is mounted without difficulty within the compressor shell and its clogging or failure will not affect the basic operation of the compressor. Finally, and very significantly, the blanket of foam created by bubbling the oil in the compressor sump in the manner taught does not tend to disturb the sediment and debris found in the bottom of the sump anywhere near to the extent mechanical agitation does since the bubbling process is, by its very nature, an upwardly directed and significantly more gentle one.

DESCRIPTION OF THE DRAWING

FIG. 1 is a partial breakaway view of a compressor employing the device of the present invention.

FIGS. 2 and 3 are perspective views of alternative embodiments of the device.

DESCRIPTION OF THE PREFERRED EMBODIMENT

From the outset it should be understood that although the present invention is described in terms of a low-side reciprocating compressor, it is applicable to any compressor, whether reciprocating or not, having a shell defining an inlet into which gas flows.

Referring initially to FIG. 1, dual-piston compressor 10 is comprised of a motor-compressor unit 12 which is mounted in a hermetically sealed shell 14. Shell 14 defines a suction inlet opening 16 and an oil sump 18 the normal level in operation of which is indicated by broken line 20 in the figure. Gas is sucked from the interior of shell 14 and is compressed in cylinders 22 by the reciprocating action of pistons 24. The compressed gas is discharged into cylinder head assembly 26. From cylinder head assembly 26 the gas is discharged from shell 14 through discharge line 28. Gas discharged from shell 14 passes to condenser 30, through an expansion device 32 and through an evaporator 34 prior to being returned to suction opening 16 in shell 14 in a typical refrigeration system.

During operation of the compressor, low pressure suction gas is withdrawn from evaporator 34 and is drawn into the interior of shell 14 through suction opening 16. Motor-compressor 12 is lubricated by oil drawn from and returned to sump 18 in a manner the detail of which is not the subject of the present invention. The operation of motor-compressor 12 does, however, create a significant amount of noise within the shell which requires the implementation of a sound-silencing scheme for the compressor.

In the compressor of the present invention, a pitot tube-like device 36 is mounted within shell 14 and is preferably disposed such that inlet end 38 of the device is spaced apart from and faces directly into the stream of suction gas flowing into shell 14 through opening 16. Device 36 is, however, relatively insensitive to misalignment with respect to the incoming gas stream. A mid-portion 40 of device 36 extends generally downward from inlet end 38 and into sump 18. The angle at which mid-portion 40 extends downward from inlet end 38, while not critical, is preferably on the order of 90 degrees. Immersed in the oil in sump 18 is a third portion of the device, outlet end 42.

At its simplest, outlet end 42 of device 36 is open ended. Preferably, however, outlet end 42 defines a plurality of apertures 44 in its closed shell bottom facing end and/or in its periphery as is illustrated in FIG. 1. The mounting of device 36 within shell 14 can be accomplished in any expedient manner. FIG. 1 illustrates device 36 snapped into clip 46 which may be integrally cast into or otherwise attached to motor-compressor 12. A second clip 48 can be employed to facilitate the stabilization and positioning of device 36 within the shell and with respect to inlet opening 16.

As is illustrated in the drawing figures, inlet end 38 of device 46 is of a larger cross-sectional area than the cross-sectional area of mid-portion 40. By enlarging the cross-sectional area of inlet end 38, which faces into the incoming gas stream, a larger static pressure buildup will be achieved internal of device 36. By spacing inlet end 38 of device 36 apart from shell opening 16 it is ensured that the clogging or other failure of the device will not affect the basic delivery of suction gas to the compressor. While device 36 operates based upon pitot tube-related principles it is modified with respect to a true pitot tube arrangement in order to achieve the objects of the invention and the desired foaming of sump oil.

A typical pitot tube has an unobstructed downstream end and is employed to measure stagnation pressure. The stagnation pressure is related to the velocity of the fluid at the upstream end of the pitot tube and can be used to obtain a velocity measurement of the fluid stream into which the device is directed. Any restriction at the downstream end of the pitot tube destroys the accuracy and validity of the measurement which results and therefore the very purpose for which a pitot tube is employed. Device 36 is related to a pitot tube in the general sense that both face into a flowing fluid stream and cause a dynamic force to be converted to static pressure.

In a simple pitot tube pressure builds up in the fluid flowing into the tube until it is sufficient to withstand the impact of the main stream of fluid against the inlet end of the tube. The fluid in a pitot tube is at rest during steady state operation and the volume of the fluid in the tube is determined by the velocity of the main fluid stream. Unlike a pitot tube, however, the fluid flowing into the device of the present invention is controllably allowed to move through the device and out of submerged apertures 44 into oil sump 18 within the compressor shell. That is, the pressure allowed to develop in device 36 is sufficient to overcome the static head pressure at the location of the apertures 44 in the oil sump which is determined by, among other things, the depth of the apertures beneath the level of the oil in sump 18. In this manner gas within device 36 is allowed to move through apertures 44 and into the oil in sump 18.

Factors which affect the development and degree of static pressure buildup in device 36, among other things, include the size of the cross-sectional area of inlet end 38, the size of the cross-sectional area of mid-portion 40 and the total size, shape, number and depth of apertures 44 in outlet end 42 of the device. All of the aforementioned factors must be properly balanced to achieve a controlled and steady flow of suction gas through the apertures in the immersed portion of device 36 when the compressor is operating. It will be apparent, however, that the detailed design parameters of device 36 are governed by the operating and design parameters of the particular class or type of compressor in which it is employed. The balancing of the factors enumerated above will not be difficult for those skilled in the art given the teachings herein and the characteristics of the compressor with which they are working.

In the preferred embodiment, which is illustrated in FIG. 1, end face 50 of outlet end 42 of device 36 is closed while the submerged periphery of the outlet end 42 defines a plurality of apertures 44. FIGS. 2 and 3 illustrate alternative embodiments of device 36. In FIG. 2 device 36 includes a relatively flat and cylindrical immersed plenum 52 having apertures spaced circumferentially about its outer face 54. The use of plenum 52 allows for the distribution of gas bubbles into the sump oil over a wider area of the sump. Likewise, the device illustrated in FIG. 3 allows for still wider distribution of suction gas into the sump oil by the use of a distribution manifold 56. Manifold 56 includes arcuately extending arms which are capable of encircling the lower peripheral portion of the motor-compressor unit within the shell and also the discharge line therein, if a portion of the discharge line is located in the sump.

It will be appreciated that the gas bubbling from device 36 will not interact with the oil at the bottom of sump 18 both because of the natural tendency of the gas emanating from the immersed apertures to rise and because of the remoteness of the apertures from the central lower sump location. Therefore, the disturbance of sediment and debris at the bottom of the sump will not occur as a result of the foaming of sump oil with any embodiment of the device of the present invention.

OPERATION

In operation, a portion of the suction gas fluid stream entering shell 14 through suction inlet opening 16 is diverted and enters inlet end 38 of device 36 which is positioned apart from but in the vicinity of opening 16. Since outlet end 42 of the device, which includes apertures 44, is submerged in the oil within sump 18, the suction gas entering device 36 encounters a resistance to flow which is primarily determined by the head pressure at the location of the apertures and the size of the apertures in submerged outlet end 42 of the device. The number and shape of apertures 44 also affect the ability of suction gas to flow through the device and out of apertures 44.

Due to the flow resistance encountered by the diverted incoming gas stream within device 36, the velocity or dynamic head of the fluid stream within the device is at least partially converted to static pressure. In a true pitot tube, the tube opening is directed upstream so that fluid flows into the pitot tube opening until pressure builds within the tube sufficiently to withstand the impact of the velocity of the fluid stream against it. At a point directly in front of the pitot tube opening, the fluid in the flowing fluid stream will be at rest as will be the fluid in the pitot tube. In the device of the present invention, however, the cross-sectional areas of the various sections of the device as well as the number, shape, size and depth of the apertures in the submerged end of the device are predetermined in accordance with the compressor's operating and mechanical characteristics so that when the compressor is operating the static pressure buildup within device 36 exceeds the head at the apertures in the submerged end of the device. In this manner, a steady and controlled flow of suction gas through the device and out of apertures 44 is established at a predetermined and optimum rate. Such steady flow of gas into the sump oil through apertures 44 causes the local formation of bubbles within the sump oil at the aperture locations. The bubbles rise to the surface of the oil in the sump where they coalesce, creating a foamy blanket of sound attenuating bubbles around the motor-compressor unit within the shell.

Prior to compressor start-up, submerged outlet portion 42 of device 36 will be flooded with oil to the same level as the level of the oil within the sump. Upon start-up of the compressor static pressure will quickly build within device 36 and will rise to a point such that the oil within the device will be forced through and out of apertures 44. The steady flow of suction gas through the apertures will then be established. Once again, it will be apparent to those skilled in the art that compressor operating and mechanical characteristics will be determinative of the physical parameters and dimensions of device 36. Clearly, however, the device must be dimensioned such that sufficient static head can be built up within it to initially clear the device of oil and then to continue to drive suction gas through the apertures and into the oil in the sump.

It will be appreciated that device 36 can be fabricated from any of a number of materials with a high temperature tolerant, plastic-like material being preferred. Fabrication of device 36 from plastic is advantageous from the standpoint of cost, ease of manufacture, flexibility, weight, durability and from the standpoint of its being able to be deformably clipped into mounting clips 46 and 48. While mounting clips 46 and 48 are preferably attached to motor-compressor unit 12, they might also be manufactured so as to extend directly from shell 14.

While a preferred embodiment and two alternative embodiments of the present invention have been described, the invention clearly is not to be limited thereto but rather, is limited only by the scope of the following claims.

What is claimed is:

1. A compressor comprising:

a shell having a suction gas inlet, said inlet opening into the interior of said shell and said shell defining an oil sump;

a motor-compressor disposed in the interior of said shell and operable to compress the gas entering said shell through said inlet; and means disposed in said shell and at least partially immersed in the oil in said sump, for internally converting the velocity head of gas entering said shell inlet into static pressure, said converting means having an inlet end, the immersed portion of said converting means defining an aperture through which at least a portion of said gas entering said shell is delivered into the oil in said sump under the impetus of the static pressure developed within said converting means and said inlet end of said converting means being positioned and aligned in said shell so as to face generally into the flow of gas entering said shell inlet, said inlet end of said converting means being spaced apart from and physically uncommunicative with said shell inlet so that upon the occlusion of said converting means the flow of suction gas into said shell continues essentially unaffected and the starvation of said motor-compressor of suction gas is prevented from occurring.

2. The compressor according to claim 1 wherein said inlet end of said tube-like device has a cross-sectional area larger than the cross-sectional area of the portion of said device connecting said inlet end to the immersed portion of said device.

3. The compressor according to claim 2 wherein said converting means is mounted to said motor-compressor.

4. The compressor according to claim 2 wherein the immersed portion of said converting means has a plenum defining a plurality of apertures, said plenum having a cross-sectional area larger than the cross-sectional area of the portion of the tube-like device connecting said inlet end with immersed portion.

5. The compressor according to claim 2 wherein the immersed portion of said converting means has at least one generally horizontally extending arcuate manifold which defines a plurality of apertures, said manifold extending around the periphery of said motor-compressor within the oil in said sump.

6. The compressor according to claim 2 wherein the immersed portion of said converting means has a plurality of apertures of a number, size and shape and at a depth in said sump whereby a foamy blanket of sound attenuating bubbles is created on the surface of the oil in said sump by the controlled introduction of suction gas into the oil in said sump through said apertures.

7. The compressor according to claim 2 wherein the immersed portion of said converting means is cylindrical and has a closed end facing the bottom of the oil sump in said shell, said immersed portion defining a plurality of apertures about its periphery.

8. A method of attenuating the noise generated by a motor-compressor unit in a low-side hermetic compressor comprising the steps of:

delivering suction gas into the interior of the shell of the compressor through an opening;

positioning a device having an inlet end and a portion at least partially immersed in an oil sump internal of said compressor shell so that the inlet end of the device faces generally into the flow of gas entering the shell opening, said device diverting the flow of a portion of the gas entering the compressor shell and the inlet end of said device being physically spaced apart from and uncommunicative with the shell opening so that upon the occlusion of said device the flow of suction gas into said shell continues essentially unaffected and the starvation of said motor-compressor of suction gas is prevented from occurring converting the velocity head of the diverted portion of the suction gas to static pressure internal of said device; and employing the static pressure so developed to drive suction gas into the oil in the sump of the compressor through the end of said device immersed therein.

9. The method according to claim 8 wherein said diverting step includes the step of facing a tube-like device into the stream of suction gas delivered into the interior of the compressor shell.

10. The method according to claim 9 wherein said converting step includes the step of resisting the flow of gas through the tube-like device.

11. The method according to claim 10 wherein said resisting step includes the steps of immersing a portion of the tube-like device in the oil in the sump of the compressor and exposing the interior of the tube-like device to a head determined by the depth of the oil in the sump.

12. The method according to claim 11 wherein said employing step includes the step of overcoming the head determined by the depth of the oil in the sump.

* * * * *